US007700863B2

(12) United States Patent
Bear

(10) Patent No.: US 7,700,863 B2
(45) Date of Patent: Apr. 20, 2010

(54) INSTRUMENT

(76) Inventor: Jonathan Bear, 6540 Dalzell Pl., Pittsburgh, PA (US) 15217

( * ) Notice: Subject to any disclaimer, the term of this patent is extended or adjusted under 35 U.S.C. 154(b) by 150 days.

(21) Appl. No.: 11/200,217

(22) Filed: Aug. 9, 2005

(65) Prior Publication Data

US 2007/0044634 A1 Mar. 1, 2007

(51) Int. Cl.
*G10D 7/00* (2006.01)

(52) U.S. Cl. ..... 84/380 R; 84/384

(58) Field of Classification Search ..... 84/380 R, 84/384; D17/10, 13

See application file for complete search history.

(56) References Cited

U.S. PATENT DOCUMENTS

| | | | | | |
|---|---|---|---|---|---|
| 594,735 | A * | 11/1897 | Giorgi | 84/384 |
| 2,202,410 | A | 5/1940 | Walberg | |
| 3,011,382 | A | 12/1961 | Kim | |
| 3,326,073 | A | 6/1967 | Tremaine | |
| 3,363,498 | A | 1/1968 | Uebel et al. | |
| 3,722,348 | A | 3/1973 | Visser | |
| 4,714,000 | A | 12/1987 | Braun | |
| 4,998,456 | A | 3/1991 | Kahonen | |
| 5,309,806 | A * | 5/1994 | Stavash | 84/380 R |
| 6,002,080 | A * | 12/1999 | Tanaka | 84/615 |
| 6,696,629 | B1 * | 2/2004 | Cooper, Jr. | 84/385 R |
| 2003/0024373 | A1 * | 2/2003 | Louis | 84/385 R |

FOREIGN PATENT DOCUMENTS

| | | |
|---|---|---|
| WO | WO 88/04462 | 6/1988 |

* cited by examiner

*Primary Examiner*—Jianchun Qin
(74) *Attorney, Agent, or Firm*—Bartony & Associates, LLC.

(57) ABSTRACT

A wind instrument, includes: a hollow tube having an open lower or distal end; a mouth hole formed in an upper or proximal portion the tube; a first set of holes including three holes formed in the tube for application of an index finger, a middle finger and a ring finger of an upper hand of a user; and a second set of hole including five holes formed in the tube for application of a thumb, an index finger, a middle finger, a ring finger and a pinky finger of a lower hand of the user. Another wind instrument, includes: a hollow tube having an open lower or distal end; a mouth hole formed in an upper or proximal portion the tube; a first finger support attached to and extending away from the tube; and a second finger support attached to and extending away from the tube.

8 Claims, 3 Drawing Sheets

INSTRUMENT

BACKGROUND OF THE INVENTION

The present invention relates to wind instruments, and particularly, to flutes.

A wide variety of wind instruments have been developed over the years. Woodwind instruments include any of a group of wind instruments (for example, the clarinet, the flute, the oboe, and the saxophone) that are generally characterized by a cylindrical or conical tube of material (for example, wood or metal), sometimes ending in a slightly flared bell. These instruments produce tones by the vibration of one or two reeds in the mouthpiece or by the passing of air over a mouth hole. Wind instruments usually have finger holes or keys by which the player may produce all the tones within an instrument's range Flutes are wind instrument of ancient origin that were formerly made of wood, but now are typically made from silver and other metals. Sound is produced in various types of flutes by either blowing across a round mouth-hole (whether in end-blown flutes such as panpipes or in transverse, side-blown flute) or by blowing into a whistle mouthpiece (as in the recorder or flageolet). The modern flute is descended from the German (transverse) flute. Modern era flutes are typically predominantly cylindrical in bore (while typically having a slight taper in the mouthpiece end) and stopped at one end. The player's breath causes vibration of a column of air inside the tube. The mouth-hole of the flute causes the flute to act acoustically as an open tube.

The traditional keyless flute typically has six holes, and cannot obtain all the chromatic notes with good intonation, even over a single octave. Furthermore, obtaining some of the chromatic notes on such instruments requires "half-holing" or covering only part of a hole. Half-holing is a difficult technique and produces inconsistent results, particularly during fast passages. Half-holing also produces very inferior tone quality. Additional holes have been added to some instruments to address this problem. Simple system, six-holed flutes have been made chromatic by the addition of holes controlled by key mechanisms. This design trend culminated in the development of the modern orchestral instrument by Theobold Boehm.

The modern orchestral (Boehm) flute, and its predecessor, the eight keyed classical flute, are truly chromatic designs which possess many desirable qualities. However, these qualities are obtained by means of a complex and delicate arrangement of mechanical keys. The manufacture of this key mechanism is precise and time-consuming, and therefore costly. Furthermore, the mechanism of the modern flute is delicate. A simple mishap, such as dropping the instrument onto the floor, often renders the instrument inoperable until repaired, at great expense, by a professional technician.

There are other musical instruments that are usually used in a manner similar to flute. For example, the recorder is a keyless instrument that obtains all chromatic notes. However, the recorder is a fipple flute (a whistle) and does not offer the embouchure control available on a flute. It is a difficult instrument to learn in that the fingerings vary dramatically between octaves. The recorder has a tapered bore, making it difficult and expensive to manufacture. Moreover, the recorder is a quiet instrument, best suited to baroque ensembles, and cannot be matched with modern instruments such as the saxophone or the drum set.

In general, both of the hands of the musician are required to support flutes and similar woodwind instruments during playing. Use of the thumb of the lower hand (typically the right hand) for fingering notes is not possible as the thumb of the lower hand is required to support the instrument. On several such instruments, a thumb rest for the thumb of the lower hand is provided.

It is desirable to develop alternative wind instruments, and particularly flutes, that provide a chromatic range and yet reduce or eliminate at least some of the problems associated with currently available instruments.

SUMMARY OF THE INVENTION

In one aspect, the present invention provides a wind instrument, including: a hollow tube having an open lower or distal end; a mouth hole formed in an upper or proximal portion the tube; a first set of holes including three holes formed in the tube for application of an index finger, a middle finger and a ring finger of an upper hand of a user; and a second set of hole including five holes formed in the tube for application of a thumb, an index finger, a middle finger, a ring finger and a pinky finger of a lower hand of the user. In one embodiment, the hole of the second set of holes to which the thumb of the lower hand is to be applied is rotated about the axis of the instrument from the one or more of the other holes. For example, the thumb hole for the second set of holes (that is, the holes for the lower hand) can be formed in the tube approximately 180° about the axis of the tube from the hole of the second set of holes to which the index finger of the lower hand is to be applied. Likewise, the hole of the second set of holes to which the pinky finger of the lower hand is to be applied can be rotated about the axis of the instrument from the position of the holes to which the index, middle and/or ring fingers are applied. The position of the hole for the pinker finger of the lower hand can, for example be rotated from approximately 15 to 45° from the position of the ring finger hole.

In one embodiment, the wind instrument also includes a first finger support attached to and extending away from the tube and a second finger support attached to and extending away from the tube. The first finger support can, for example, be attached to the tube above the first set of holes, and the second finger support can be attached to the tube below the first set of holes. The first finger support can be adapted to be abutted or grasped by the thumb of the upper hand of the user, and the second finger support can be adapted to be abutted or grasped by the pinky finger of the upper hand of the user. The finger supports enable the instrument to be supported by the upper hand only and provide freedom for all five fingers of the lower hand to finger notes. At least one of the first finger support and the second finger support can be adjustable in position along the length of the wind instrument.

The tube of the instrument can, for example, be generally cylindrical over at least a portion thereof. Likewise, the tube of the instrument can be generally conical over at least a portion thereof. In one embodiment, the instrument is keyless. However, keys can be used in the instruments of the present invention.

In another aspect, the present invention provides a wind instrument, including: a hollow tube having an open lower or distal end; a mouth hole formed in an upper or proximal portion the tube; a first finger support attached to and extending away from the tube; and a second finger support attached to and extending away from the tube. The first finger support can, for example, be adapted to be grasped by a thumb of a hand (for example, the upper hand) of the user, and the second finger support can be adapted to be grasped by a pinky finger of the hand of the user. As described above, at least one of the first finger support and the second finger support can be adjustable in position along the length of the wind instrument. The tube of the wind instrument can be generally cylindrical over at least a portion thereof and/or can be generally conical over at least a portion thereof.

BRIEF DESCRIPTION OF THE DRAWINGS

Other aspects of the invention and their advantages will be discerned from the following detailed description when read in connection with the accompanying drawings, in which.

DETAILED DESCRIPTION OF THE INVENTION

The present invention provides chromatic flutes having a unique fingering system and a unique grasping system. The flutes of the present invention are very versatile instruments which are, durable, as well as simple and inexpensive to manufacture. The flutes of the present invention, while easy to learn, provide good intonation, good facility of execution and good ergonomics to the human hand.

Figure 1:
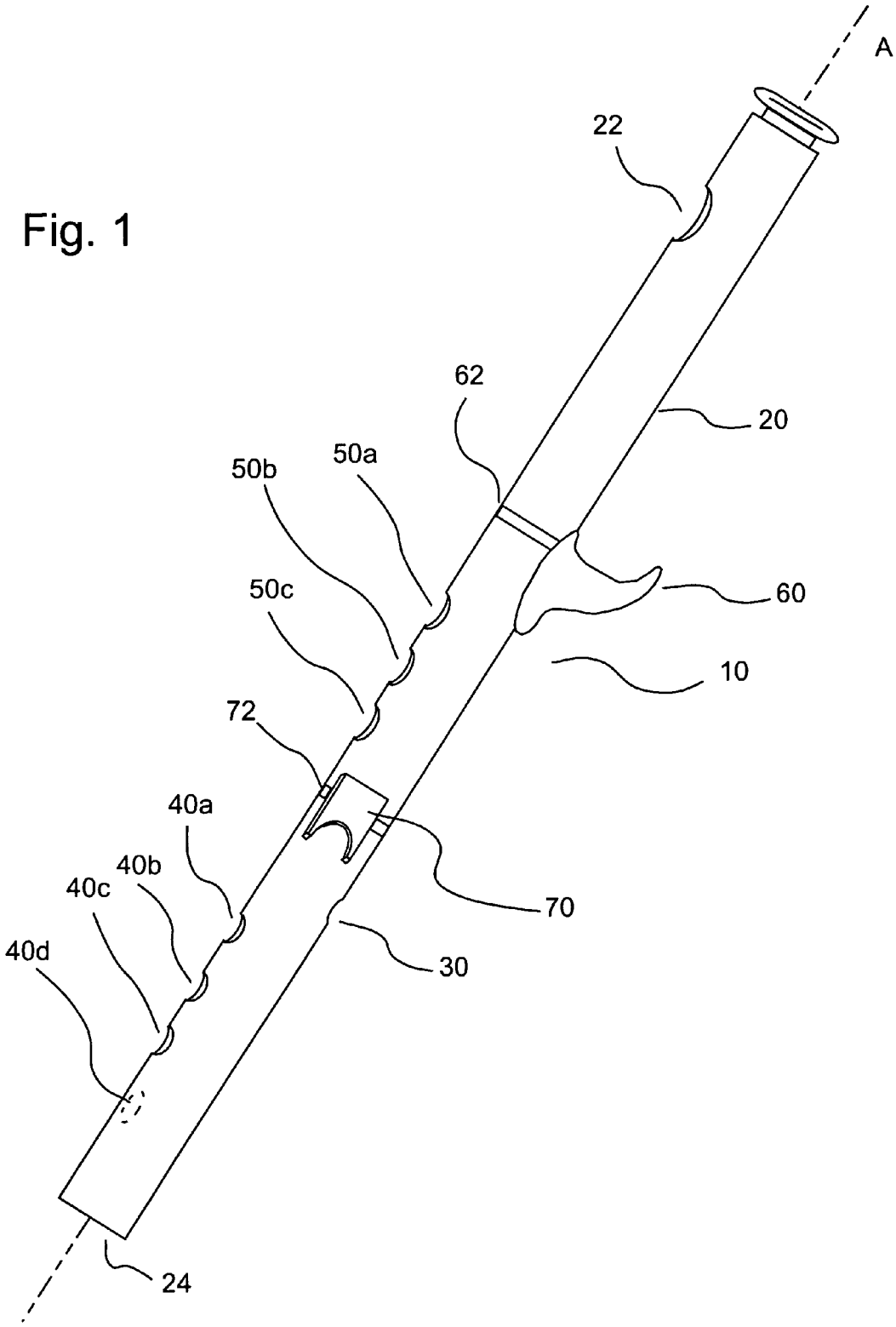
FIG. 1 illustrates a perspective view of one embodiment of a flute of the present invention.

FIG. 1 illustrates an embodiment of the present invention, providing an 8-holed, keyless, flute 10 including a generally cylindrical tube 20 having a mouth hole 22 formed near a first, upper or proximal end thereof. The proximal end of tube 20 can, for example, be closed by a plug, approximately one tube diameter from the center of mouth hole 22. A second, lower or distal end 24 of tube 20 is open. Flute 10 is capable of a two octave chromatic range. In the fingering system of flute 10, five holes 30, 40*a*, 40*b*, 40*c* and 40*d* are covered by the thumb and fingers of the lower (usually right) hand, respectively. Three holes 50*a*, 50*b* and 50*c* are covered by the index, the middle finger and the ring finger, respectively, of the upper (usually left) hand. The holes are preferably sized and positioned such that all the notes of the equal tempered scale (and many microtones as well) can be obtained over a two octave range.

The position and size of the holes can be determined according to the known principles of flutemaking and varies based on specific length, diameter, bore profile and wall thickness of flute 10. Some of the major principles involved include: a) larger holes give better tone; b) hole size can be traded for hole position as smaller holes can be placed more proximally (higher up) on the flute; c) the effects of hole size and position vary between octaves; d) notes in higher octaves are obtained by harmonics in the bore—this often involves placing the holes above nodes or antinodes of these harmonics, such that when opened, they disrupt undesirable harmonics and reinforce the desired harmonic, and this effect is largely independent of hole size.

Figure 2:
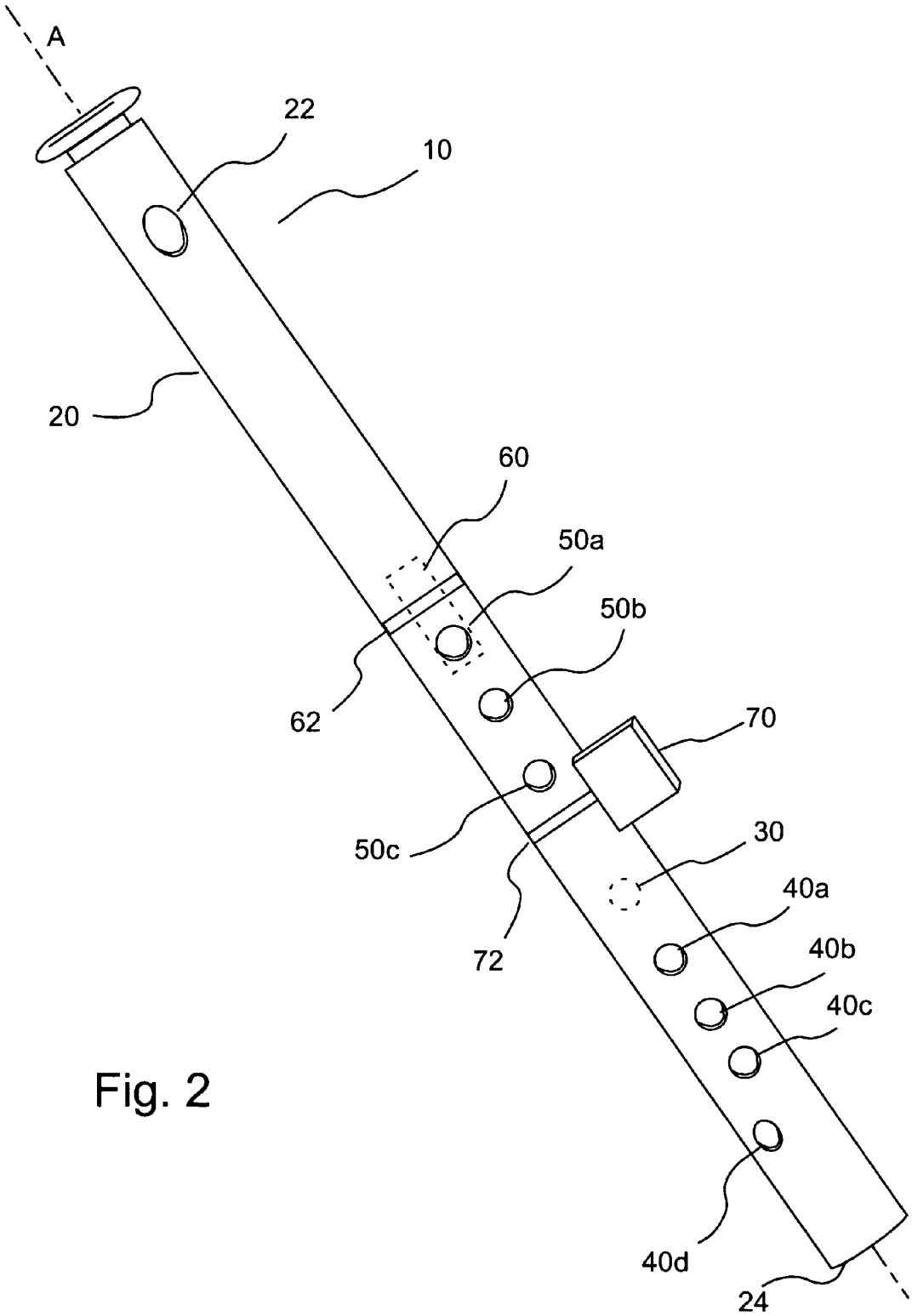
FIG. 2 illustrates another perspective view of the flute of FIG. 1 in which the flute is rotate about its axis by approximately 90° from the orientation of FIG. 1.

The hole distribution of flute 10 is naturally ergonomic to the human hand, allowing slight variations in hole size and position to be made as required for good intonation, without sacrificing ergonomic factors. As illustrated in, FIGS. 1 and 2, holes 40*a*, 40*b* and 40*c* are in general alignment for ready and ergonomic access by the index finger, the middle finger and the ring finger, respectively, of the lower hand. In the embodiment of FIGS. 1 and 2, the position of hole 30 is rotated about axis A of flute 10 approximately 180° from the positions of holes 40*a*, 40*b*, and 40*c* for ready and ergonomic access by the thumb of the lower hand. Likewise, hole 40*d* is rotated (for example, by approximately 15 to 45°) about axis A of flute 10 from the positions of holes 40*a*, 40*b* and 40*c* for ready and ergonomic access by the pinky finger of the lower hand. Holes 50*a*, 50*b* and 50*c* are in general alignment for ready and ergonomic access by the index finger, the middle finger and the ring finger, respectively, of the upper hand. In the illustrated embodiment, holes 40*a*, 40*b*, 40*c*, 50*a*, 50*b*, and 50*c* are all in general alignment. As clear to one skilled in the art, modifications of the hole positions described above can be made.

Preferably, flute 10 includes two radially outward extending protrusions that can be in the form of finger supports or blocks 60 and 70. Finger block 60 is grasped or abutted by the thumb of the upper hand, while finger block 70 is grasped or abutted by the pinky finger of the upper hand. The position of finger blocks 60 and 70 can, for example, be adjusted to fit the hand of the player using adjustable attachment rings 62 and 72, respectively. Use of finger blocks 60 and 70 allows the remaining eight fingers to achieve complete freedom of movement. Such freedom of movement facilitates realization of the full benefits of the unique fingering system of the flutes of the present invention. In that regard, finger blocks 60 and 70 allow flute 10 to be completely supported without the use of the thumb of the lower hand, which is thus allowed to move freely as needed to cover or uncover its assigned tone hole 30.

Five consecutive semitone holes 30, 40*a*, 40*b*, 40*c* and 40*d* at the low end of flute 10 allow excellent tone and intonation for the corresponding notes and increase the options for other fingerings involving upper three holes 50*a*, 50*b* and 50*c*. As the holes can be approximately equally spaced, they are naturally ergonomic to the human hand. The lower holes on other flutes (excepting the modern Boehm system flutes) require that hole position be adjusted by changes in hole size to obtain an ergonomically satisfactory arrangement. Specifically, the hole which in traditional designs is usually covered by the right middle finger would be too close to the hole traditionally covered by the right index finger. This is because lifting the right middle finger is intended to raise the pitch by a whole step, but lifting the right index finger is only intended to raise the pitch by a half step. Typically the hole which is usually covered by the right middle finger is made larger and the adjacent holes smaller so that they can be placed approximately equidistant from each other according to principle that hole size can be traded for hole position as smaller holes can be placed more proximally (higher up) on the flute. However, this means that hole position and size cannot be simultaneously optimized for intonation of the chromatic notes. In other words, there are three design goals: intonation of the diatonic notes, intonation of the chromatic notes, and ergonomics, but there are only two degrees of freedom: hole size and hole position. Since the traditional design uses these degrees of freedom to obtain good diatonic intonation with good ergonomics, it cannot also obtain good intonation for the chromatic notes. In flute 10, wherein the thumb of the lower hand covers tone hole 30, all three goals can be simultaneously realized in an ergonomic manner.

Use of the thumb of the lower hand is not possible on conventional designs because the thumb of the lower hand is required to support the instrument. Flute 10 is, however, supported by the thumb and little finger of the upper hand as described above. Although flute 10 can be played without use of finger blocks 60 and 70, use of finger blocks 60 and 70 for grasping by the thumb and little finger the upper hand fully relieves all other fingers of any responsibility for supporting the instrument. Finger blocks such as finger blocks 60 and 70 are useful on many types of flutes other than flute 10. As described above, when combined with the unique fingering system of flute 10, finger blocks 60 and 70 greatly enhance the advantages of the unique fingering system of flute 10 by providing total freedom of movement to the lower thumb.

Figure 3:
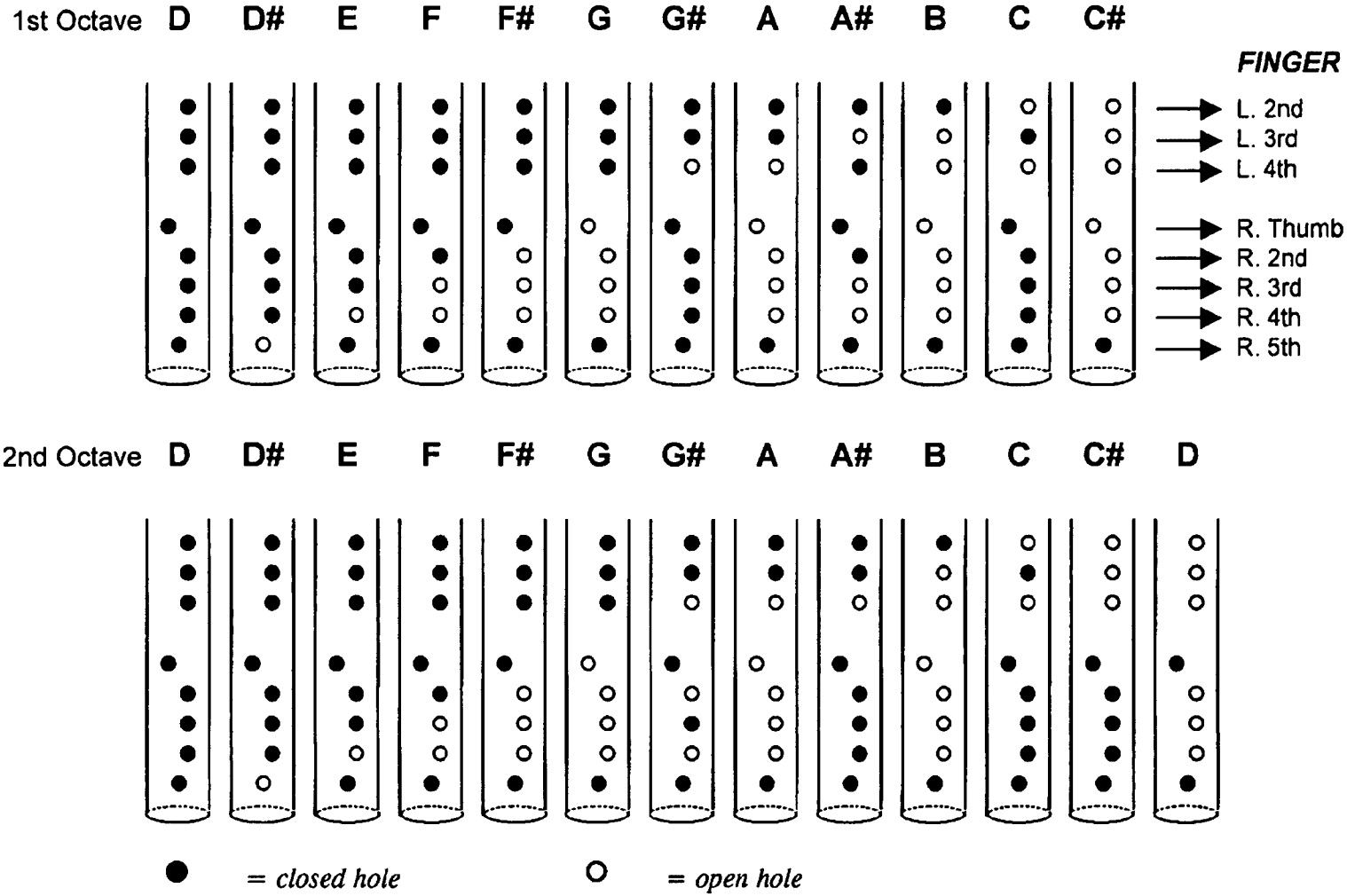
FIG. 3 illustrates a representative embodiment of a fingering chart for the flutes of the present invention over two octaves.

The operation of flute 10 and a number of the advantages provided by flute 10 as compared to currently available flutes and similar instruments are readily apparent from FIG. 3 which provides one embodiment of a basic fingering chart for use with flute 10. One skilled in the art appreciates, however, that the fingering provided in the fingering chart of FIG. 3 is not the only fingering that can be used with the flutes of the present invention and, indeed, may not even be the best or optimal fingering for flute 10. The fingerings illustrated in FIG. 3 illustrate, for example, the similarity of the fingering of flute 10 between octaves and the freedom of the five fingers of the lower hand (typically the right hand) to finger notes. As described above, currently available or conventional systems burden the left thumb and fifth finger extensively with playing tasks. However, the right hand in most people has greater dexterity than the left hand. Of course, the finger supports or blocks and fingering system of the present invention are readily adapted so that the right hand is the upper hand and supports the instrument and all five fingers of the left hand are free to finger notes for those with greater left hand dexterity.

As apparent from FIG. 3 and the above description of flute 10, flute 10 provides the use of all five fingers of the lower hand (the right hand in the illustrated embodiment) to operate five tone holes which can be spaced at half-step intervals. Preferably, the tone holes are ergonomically placed as described above. For example, the thumbhole for the lower hand is on the opposite side from the other holes, and lowest ($5^{th}$ finger) hole 40*d* is offset from the other holes. The $2^{nd}$, $3^{rd}$ and $4^{th}$ (that is, the index, middle and ring) fingers of the upper hand are used to operate three tone holes 50*a*, 50*b* and 50*c* which can be placed close to the usual position for the three upper tone holes on a simple system flutes (for example, a simple system, keyless diatonic flute). The use of protruding projections, abutment members, supports or finger blocks 60 and 70 for the upper thumb and fifth finger allow independent motion of all remaining fingers, including the thumb of the lower hand.

In general, the tubes of the flutes of the present invention can be made with a cylindrical bore, which simplifies (and thus reduces the cost of) manufacture compared to other bore shapes. However, virtually any other bore configuration (including, for example, conical, truncated conical etc.) is possible and indeed may lead to even better tone and intonation using the same or a similar system of holes and finger supports as described above. Such a flute, while more expensive to make, still has the benefits of ruggedness and durability, and would be much less expensive than a flute with keys, while still being chromatic.

Although the present invention has been described in detail in connection with the above embodiments and/or examples, it should be understood that such detail is illustrative and not restrictive, and that those skilled in the art can make variations without departing from the invention. The scope of the invention is indicated by the following claims rather than by the foregoing description. All changes and variations that come within the meaning and range of equivalency of the claims are to be embraced within their scope.

What is claimed is:

1. A keyless wind instrument, comprising:

a hollow tube having an open lower or distal end;

a mouth hole formed in an upper or proximal portion of the tube;

only eight finger holes arranged in a first set of holes and a second set of holes;

the first set of holes consisting of three adjacent and consecutive holes formed in the tube for application of an index finger, a middle finger and a ring finger of an upper hand of a user; and a second set of holes consisting of five adjacent and consecutive, semitone holes formed in the tube for application of a thumb, an index finger, a middle finger, a ring finger and a pinky finger of a lower hand of the user, the second set of holes being separated from the first set of holes by a space along the tube and being positioned further from the mouth hole than the first set of holes, whereby at least all notes on two chromatic octaves are readily obtainable;

a first finger support for the thumb of the upper hand attached to and extending away from the tube at a position between the mouth hole and the first set of holes; and a second finger support for the pinky finger of the upper hand attached to and extending away from the tube at a position spaced from the first finger support to be closer to the lower end than the first finger support, the first finger support and the second finger support providing for support of the wind instrument by the thumb and pinky finger of the upper hand.

2. The keyless wind instrument of claim 1 wherein the hole of the second set of holes to which the thumb is to be applied is formed in the tube approximately 180° about the axis of the tube from the hole of the second set of holes to which the index finger of the lower hand is to be applied.

3. The keyless wind instrument of claim 1 wherein the first finger support extends radially away from the tube in a generally downward direction when the wind instrument is in position to be played.

4. The keyless wind instrument of claim 3 wherein the second finger support extends radially away from the tube in a generally lateral direction when the instrument is in position to be played.

5. The keyless wind instrument of claim 4 wherein the five holes of the second set of holes are generally equally spaced along the length of the tube.

6. The keyless wind instrument of claim 1 wherein at least one of the first finger support and the second finger support is adjustable in position along the length of the wind instrument.

7. The keyless wind instrument of claim 1 wherein the tube is generally cylindrical over at least a portion thereof.

8. The keyless wind instrument of claim 1 wherein the tube is generally conical over at least a portion thereof.

* * * * *